US005698826A

United States Patent [19]

Cracraft et al.

[11] Patent Number: 5,698,826

[45] Date of Patent: Dec. 16, 1997

[54] SELECTIVE BACK LIGHTING OF APPLIANCE CONTROL PANEL

[75] Inventors: Mark A. Cracraft, Des Moines; Randall L. Cooper, Newton; Darrin S. Manke, Des Moines, all of Iowa

[73] Assignee: Maytag Corporation, Newton, Iowa

[21] Appl. No.: 719,587

[22] Filed: Sep. 25, 1996

Related U.S. Application Data

[63] Continuation of Ser. No. 382,376, Feb. 1, 1995, abandoned.

[51] Int. Cl.[6] ..... H01H 9/16

[52] U.S. Cl. ..... 200/5 A; 200/310

[58] Field of Search ..... 200/5 R, 5 A, 200/512–517, 308–317; 340/337, 690, 502, 331, 711–712; 341/22, 34, 176

[56] References Cited

U.S. PATENT DOCUMENTS

| | | | |
|---|---|---|---|
| 3,231,732 | 1/1966 | Ferguson, Jr. | 240/5 |
| 3,811,025 | 5/1974 | Bach | 200/317 |
| 3,983,553 | 9/1976 | Kesling | 340/365 R |
| 4,121,204 | 10/1978 | Welch et al. | 340/337 |
| 4,124,879 | 11/1978 | Schoemer | 362/26 |
| 4,218,603 | 8/1980 | Satoh | 200/312 |
| 4,224,530 | 9/1980 | Simcoe et al. | 307/141 |
| 4,224,615 | 9/1980 | Penz | 340/712 |
| 4,241,400 | 12/1980 | Kiefer | 364/400 |
| 4,247,747 | 1/1981 | Swatten | 200/314 |
| 4,262,182 | 4/1981 | Basler et al. | 200/314 |
| 4,322,780 | 3/1982 | Murakami et al. | 362/31 |
| 4,443,835 | 4/1984 | Brautigam et al. | 362/300 |
| 4,449,024 | 5/1984 | Stracener | 200/317 |
| 4,453,200 | 6/1984 | Trcka et al. | 362/31 |
| 4,454,501 | 6/1984 | Butts | 340/365 R |
| 4,551,598 | 11/1985 | Hamilton et al. | 200/314 |
| 4,810,044 | 3/1989 | Dahnert | 312/223 |
| 5,225,818 | 7/1993 | Lee et al. | 340/711 |
| 5,237,327 | 8/1993 | Saitoh et al. | 341/176 |
| 5,262,928 | 11/1993 | Kashima et al. | 362/31 |
| 5,464,955 | 11/1995 | Cole | 200/317 |

*Primary Examiner*—Michael L. Gellner
*Assistant Examiner*—Michael A. Friedhofer
*Attorney, Agent, or Firm*—Zarley, McKee, Thomte, Voorhees, & Sease

[57] ABSTRACT

An appliance control panel having selective backlighting includes a selection area that is normally visible to the operator including an "OPTIONS" switch. By pressing the "OPTIONS" switch, a plurality of lamps are illuminated. The light from the lamps passes through an assembly of overlays and illuminates a set of optional switches that are not normally visible. The incandescent lamps are positioned partially within a clear plastic mounting plate with a lamp on each side of the optional switches. The clear mounting plate is masked on both sides except for areas on the plate that form depressions around each optional switch. The light is trapped between the masks and escapes through the overlay assembly, illuminating the optional switches.

16 Claims, 2 Drawing Sheets

SELECTIVE BACK LIGHTING OF APPLIANCE CONTROL PANEL

This is a continuation of application Ser. No. 08/382,376 filed on Feb. 1, 1995, now abandoned.

BACKGROUND OF THE INVENTION

1. Field of the Invention

The present invention relates to selective back lighting of an appliance control panel. More particularly, the present invention relates to a control panel having a number of normally illuminated switches visible to the operator for standard operation of the appliance, and a number of special options switches that are illuminated only upon activation of an options button.

2. Background

A variety of household appliances are known in the art that include a control panel having a number of switches and indicators. In an appliance control panel, it is highly desirable that the user be able to see and understand the numerous operational switches on the control panel at a quick glance. As technology allows appliances to become more sophisticated, additional operations for specific conditions require additional switches, which present more choices to the user. As the choices compound, the control panel becomes more visually complex, and thus more difficult to quickly and easily understand.

More particularly, there are several aspects of control panels in prior art appliances which can make the control and operation of the appliance unclear or difficult for the user. For example, an appliance having various operational modes that are selectable by the user requires a large number of switches on the appliance control panel. As more switches are added to the control panel, it can become cluttered and confusing.

In recent years, manufacturers have been able to make "smart" appliances which are able to automatically select many settings which were previously selected manually. In a "smart" appliance, the user need only be required to utilize a single or at most a small number of switches since the appliance selects the options automatically. However, since the control panel may still allow the user to manually select options when desired, the control panel can become unnecessarily cluttered with a number of option selection switches which are normally not used by the user.

Another aspect that contributes to the problem of control panels being unclear is the readability of the control panel. While some control panels are lit to more clearly indicate controls to the user, it is desired that control panel lighting be selectively lit in such a way that it enhances readability and reduces confusion to the user.

FEATURES OF THE INVENTION

A primary feature of the present invention is the provision of selective back lighting for an appliance control panel.

A further feature of the present invention is the provision of selective back lighting for an appliance control panel in which a first set of unlit control switches are normally visible, and which optionally displays a second set of lighted control switches.

A further feature of the present invention is the provision of back lighting for an appliance control panel which selectively lights a portion of the control panel in a uniform manner.

A further feature of the present invention is the provision of selective back lighting for an appliance control panel on a "smart" appliance where a first set of switches are normally visible, and when desired, a second set of normally invisible switches are illuminated to display manual options and cycles to the user.

A further feature of the present invention is the provision of an appliance control panel that is lit by incandescent bulbs positioned on a circuit board between various switches.

A further feature of the present invention is the provision of back lighting for an appliance control panel which uses layers of screened inks to diffuse the light.

These, as well as other features of the present invention, will become apparent from the following specification and claims.

SUMMARY OF THE INVENTION

The selectively backlit appliance control panel of the present invention is used to simplify the user interface with an electronically controlled appliance. A dishwasher using the present invention includes a first set of switches which are normally visible to the user. The first set of switches includes a single push button "SMART START" which allows the dishwasher to automatically select the proper wash cycle. The dishwasher control panel also includes a set of optional switches which are normally not visible to the user. By pressing an "OPTIONS" button included with the first set of switches, the optional switches are illuminated and visible to the user. The user can then optionally, manually select a desired wash cycle.

The optional switches are made visible to the user through the use of selective backlighting. The backlighting is achieved by using high intensity incandescent lamps mounted to a printed circuit board. The printed circuit board is mounted behind a clear plastic mounting plate. The optional switches are centered within depressions that are formed on the front side of the mounting plate. The lamps are positioned such that they are within a round bottom hole in the back side of the mounting plate. A set of masks are applied to the front and backside of the mounting plate. When the lamps are illuminated, the light is trapped within the plastic mounting plate between the two masks. The mask on the front of the mounting plate has an opening corresponding to each depression. The light escapes through the opening in the mask and illuminates the wording to show the optional switches on the control panel.

DETAILED DESCRIPTION OF THE PREFERRED EMBODIMENT

The present invention will be described as it applies to its preferred embodiment. It is not intended that the present invention be limited to the described embodiment. It is intended that the invention cover all alternatives, modifications, and equivalences which may be included within the spirit and scope of the invention. The present invention will also be described as it applies to an automatic dishwasher. It is understood that the control panel with selective backlighting can also be used on other appliances or machines wherein various operational modes may be chosen by the user.

Figures 1, 5:
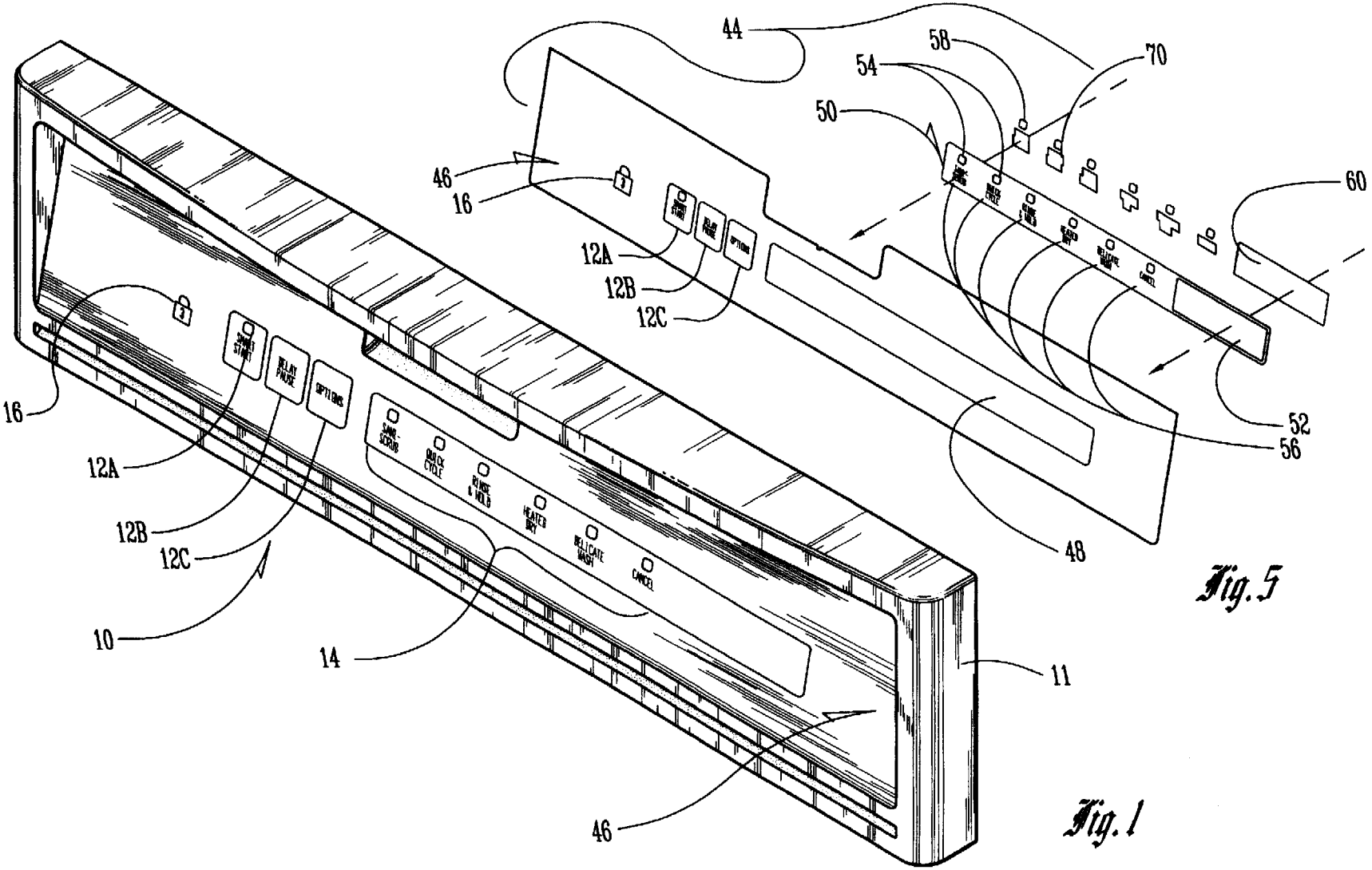
FIG. 1 is a perspective view of an appliance control panel of the present invention.
FIG. 5 is an exploded view of the overlay assembly for the appliance control panel of the present invention.

FIG. 1 shows a control panel 10 for an automatic dishwasher utilizing the present invention. The control panel 10 includes three primary switch pads 12A, 12B, and 12C, six optional switch pads 14, and one child lock switch pad 16. The operation of the dishwasher is controlled by the user through the switch pads 12, 14, and 16.

Figure 2:
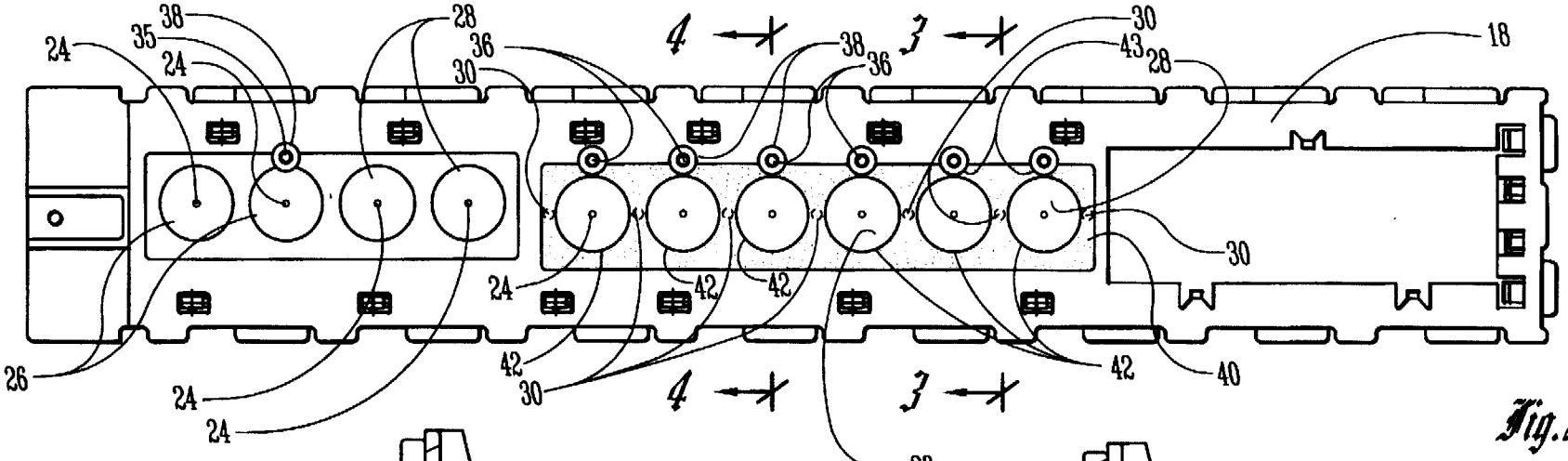
FIG. 2 is a plan view of a mounting plate for use with an appliance control panel of the present invention.
Figure 3:
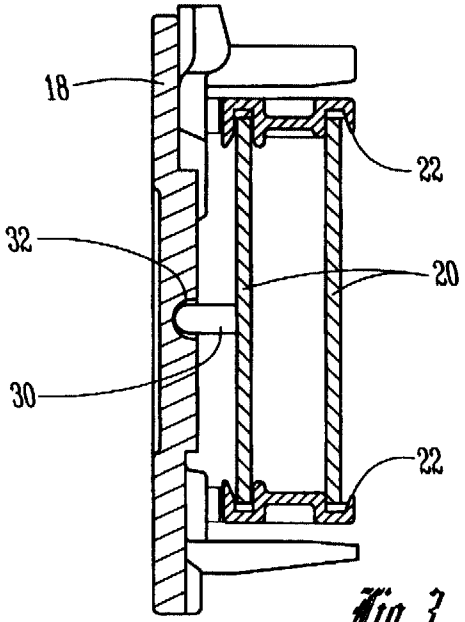
FIG. 3 is a cross-sectional side view taken generally along line 3—3 in FIG. 2.
Figure 4:
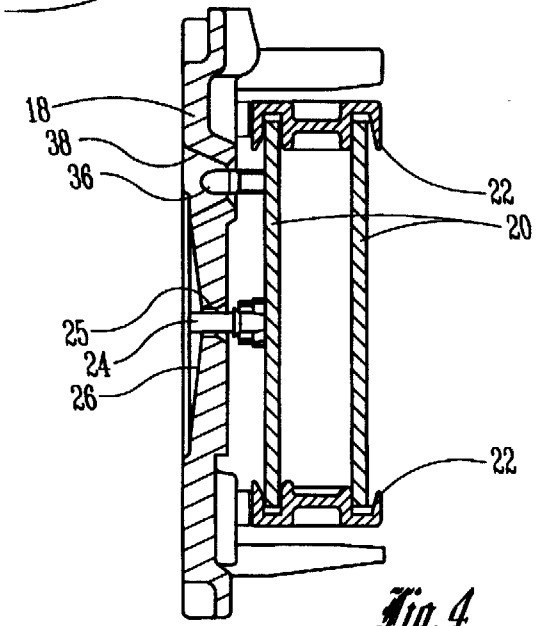
FIG. 4 is a cross-sectional side view taken substantially along line 4—4 in FIG. 2.

FIG. 2 shows a front view of a mounting plate 18 which is part of the control panel 10. The mounting plate 18 is made from a clear plastic material and is coupled to the back side of the control panel housing or frame 11. As shown in FIGS. 3 and 4, two circuit boards 20 are coupled to the mounting plate 18 via mounting rails 22. The mounting rails 22 are in turn coupled to the mounting plate 18. Ten push button switches 24 are mounted to one of the printed circuit boards 20 as shown in FIG. 4. A plurality of push button holes 25 are formed in the mounting plate 18 at positions corresponding to each of the switches 24, as shown in FIG. 2. When the mounting plate 18 is assembled with circuit boards 20, each push button of each switch 24 extends through the mounting plate 18 via the push button holes 25 (FIG. 4). For each switch 24, a depression 26 is formed around the corresponding hole 25 in the mounting plate 18 (FIG. 4). The depressions 26 each form a switch area 28 as shown in FIG. 2. Since the push buttons of switches 24 extend through mounting plate 18 and depressions 26 are formed in the mounting plate 18, the user can actuate a push button of a switch 24 by pressing at the switch area 28.

As shown in FIGS. 2 and 3, seven incandescent lamps 30 are coupled to one of the circuit boards 20. The lamps 30 each extend partially into mounting plate 18 at the round bottom holes 32 (FIG. 3) which are formed in the clear plastic mounting plate 18. Each switch area 28 corresponding to optional switch pads 14 has a lamp 30 positioned on each side, as best shown in FIG. 2 as hidden lines.

As shown in FIGS. 2 and 4, a number of light emitting diodes 35, 36 are coupled to one of the circuit boards 20. Each LED 35, 36 extends through the mounting plate 18 through the LED openings 38 (FIGS. 2 and 4). Each LED 36 corresponds to the switch 24 located directly below it and as discussed below.

FIG. 2 also shows a mask 40 that may comprise a sheet of mylar mounted to both the front and back of the mounting plate 18 or, alternately, both front and back may be painted in this area. The mask 40 has mask openings 42 (FIG. 2) formed in it which each leave the adjacent switch area 28 unmasked. Similarly, the mask 40 has arcuate LED mask openings shown at 43 which allow the LED's 36 to be unmasked. The mask 40 may also be extended to cover the top to bottom height of the mounting plate 18.

FIG. 5 shows an overlay assembly 44 which is disposed between the user and the mounting plate 18. The overlay assembly 44 includes a front overlay 46. The front overlay 46 is preferably made from a clear polycarbonate. Printed on the back of the front overlay 46 are indicators for the primary switch pads 12 and the child lock switch pad 16 as shown in FIGS. 1 and 5. Front overlay 46 has a graphics area 48 which is transparent and will be positioned over a digital display that will be visible to the user. Disposed on the back side of the front overlay 46 is a layer of screened opaque ink identified by numeral 50. The remainder of the back surface of front overlay 46 is also screened with opaque ink. The layer 50 includes transparent display portion 52, transparent LED portions 54 and transparent nomenclature portions 56. Placed over the transparent LED portions 54 are red diffusing tints 58. Disposed over the transparent display portion 52 and 56 is the display tint 60. The tint 60 is preferably a screened gray tint on the back of the polycarbonate front overlay 46. Disposed on the transparent nomenclature portions 56 is a layer of nomenclature screened ink diffuser 70. Preferably, in this embodiment, the nomenclature screened ink diffuser 70 is screened on the back of gray tint.

The operation of the present invention is as follows. The dishwasher described is of the "smart" type which is able to sense certain conditions in the dishwasher and can automatically make adjustments accordingly. The control panel 10 includes a child lock switch pad 16 which can be pressed to disable the remainder of the switches. When the child lock switch 16 is pressed again, the remainder of the switches are enabled.

One of the primary switch pads 12A (FIG. 1) is a "SMART START" button which activates the dishwasher and allows it to run in the automatic mode. If the user selects the "SMART START" button, the corresponding LED 35 will illuminate, showing the user that it was selected. Under normal conditions, only the three primary switch pads 12A, 12B, 12C, and the child lock switch pad 16 are visible to the user. The primary switch pads 12A, 12B and 12C can include, for example, "SMART START", "DELAY PAUSE", and "OPTIONS". Under normal circumstances, these are the only switch pads that the user needs to see. If the user wishes to choose a specific cycle, as opposed to the "smart" cycle, the "OPTIONS" switch pad 12C can be pressed. When the option switch pad 12C is pressed, the seven incandescent lamps 30 that are coupled to the control circuit boards 20 are illuminated, revealing the optional switch pads 14. Switch pads 14 are inactive until the "OPTIONS" switch pad 12C is activated, whereinafter circuitry associated with the boards 20 activate the switches 24 associated with the optional switch pads 14.

The incandescent lamps 30 are positioned such that they are located within the round bottom holes 32 as shown in FIG. 3. The filaments of the bulbs 30 are positioned above the back side of the mounting plate 18 but below the front side of the mounting plate 18. As a result, the light from the lamps 30 is projected throughout the clear plastic mounting plate 18. To help contain the light within the mounting plate 18, masks 40 are attached to the front and back side of the mounting plate 18. The light emitted from the lamps 30 is then trapped within the plastic mounting plate 18 and the masks 40. Since the masks 40 have openings 42, the trapped light is allowed to "escape" through the openings 42. This light is now available for back lighting of the optional switch pads 14. The back lighting uses the overlay assembly 44 to obtain the desired result. When the lamps 30 are not turned on, the front of the overlay will appear as a darkened area. When the back lighting is turned on by activation of "OPTIONS" switch pad 12C, the light will project through the overlay assembly 44, and illuminate the nomenclature of the optional switches 14. At this time, the optional switch pads 14 are active and easily visible to the user. If the user selects one of the optional switch pads 14, the corresponding LED 36 will illuminate, showing the user which optional switch was selected.

The result of this operation is that the interface of the dishwasher and the user is simplified in appearance and functionality. The user is not confused or distracted by options and features which are not normally used. For example, options such as "SANI SCRUB", "QUICK WASH", "RINSE AND HOLD", "HEAT DRY", "DELICATE WASH", AND "CANCEL" are not normally visible to the user, but upon pressing the "OPTIONS" button, they are visible. The control panel 10 will therefore appear more straight forward by displaying only the necessary switches for operation.

The preferred embodiment of the present invention has been set forth in the drawings and specification, and although specific terms are employed, these are used in a generic or descriptive sense only an are not used for purposes of limitations. Changes in the form and proportion of parts as well as in the substitution of equivalents are contemplated as circumstances may suggest or render expedient without departing from the spirit and scope of the invention as further defined in the following claims.

What is claimed is:

1. A control panel electrically connected to a washing appliance, comprising:

a mounting plate;

at least one circuit board coupled to the mounting plate and containing electronic circuitry for controlling the washing appliance operation;

a plurality of primary control switches operatively connected to the circuit board including a first primary switch actuatable for enabling the electronic circuitry to automatically select and initiate an appropriate cycle from a plurality of alternative cycles of washing operations of the washing appliance and a second primary switch actuatable for activating and illuminating optional washing cycle choices;

a plurality of secondary control switches operatively connected to the circuit board and to the electronic circuitry through the second primary switch for providing manual selection of the optional washing cycle choices for the washing appliance, rather than the automatically selected cycle of washing operations;

a light source including a lamp for illuminating the plurality of secondary control switches and being operatively connected to the second primary switch so as to be selectively activated only when the second primary switch is activated; and the secondary control switches normally being visually concealed and being illuminated by the lamp so as to be visually revealed to a user only when the light source is activated.

2. The control panel of claim 1 wherein the light source is comprised of a plurality of incandescent lamps.

3. The control panel of claim 2 wherein the lamps extend partially into lamp recesses formed in the mounting plate.

4. The control panel of claim 1 wherein the mounting plate includes at least one masked area for preventing transmission of light therethrough.

5. The control panel of claim 4 wherein the masked area includes a layer of mylar.

6. The control panel of claim 1 further comprising an overlay assembly attached to the mounting plate and including diffusers for displaying control switch indicators.

7. The control panel of claim 6 wherein the overlay assembly includes a screened red diffusing tint.

8. The control panel of claim 4 wherein the masked area includes an opening to permit light to be transmitted therethrough.

9. The control panel of claim 4 wherein the mounting plate includes a masked layer on two opposite sides of the mounting plate.

10. The control panel of claim 1 wherein at least a portion of the primary and secondary control switches are disposed partially in a recess formed in the mounting plate.

11. The control panel of claim 1 further comprising a plurality of light emitting diodes, each positioned proximate a control switch and being electrically connected to the circuit board, wherein the light emitting diodes illuminate when the adjacent control switch is switched.

12. A control panel mounted to an appliance, comprising:

a first control panel selection area having primary switches for controlling primary operations of the appliance, one of the primary switches being an options switch;

a second control panel selection area having optional switches for selectively controlling optional operations of the appliance;

the first control panel selection area normally being visible to an operator;

the second control panel selection area normally being inoperative and visually indistinguishable to the operator, and being operable and visually distinguishable upon activation of the options switch; and at least one lamp operatively connected to the options switch to illuminate the second selection area for visual observation by the operator when the options switch is activated.

13. The control panel of claim 12 further comprising a control panel overlay having nomenclature for identifying the primary and optional switches.

14. The control panel of claim 13 wherein the nomenclature for the optional switches is visible only after the lighting is activated.

15. The control panel of claim 12 further comprising a masking layer having openings therein to confine the illumination from the lighting to the second control panel selection area.

16. The control panel of claim 12 wherein the lighting extends into a recess formed in the control panel.

* * * * *